US008465197B2

(12) United States Patent
Faccioli et al.

(10) Patent No.: US 8,465,197 B2
(45) Date of Patent: Jun. 18, 2013

(54) CARTRIDGE FOR STERILE MIXING OF A TWO-PHASE COMPOUND, PARTICULARLY FOR TWO-COMPONENT ACRYLIC RESINS

(75) Inventors: Giovanni Faccioli, Monzambano (IT); Renzo Soffiatti, Nogara (IT)

(73) Assignee: Tecres S.p.A., Sommacampagna (IT)

( * ) Notice: Subject to any disclaimer, the term of this patent is extended or adjusted under 35 U.S.C. 154(b) by 1225 days.

(21) Appl. No.: 11/922,704

(22) PCT Filed: May 16, 2006

(86) PCT No.: PCT/IB2006/001275
§ 371 (c)(1),
(2), (4) Date: Dec. 21, 2007

(87) PCT Pub. No.: WO2007/000631
PCT Pub. Date: Jan. 4, 2007

(65) Prior Publication Data

US 2009/0207686 A1 Aug. 20, 2009

(30) Foreign Application Priority Data

Jun. 28, 2005 (IT) ..... VI2005A0187

(51) Int. Cl.
*B01F 13/00* (2006.01)
*B01F 15/02* (2006.01)
*B01F 15/00* (2006.01)

(52) U.S. Cl.
USPC ..... 366/130; 366/139; 366/150.1; 366/182.3; 366/189; 366/163.1; 366/192; 366/194; 366/129

(58) Field of Classification Search
USPC ..... 366/130, 139, 150.1, 182.3, 189, 366/163.1, 192, 194, 129
See application file for complete search history.

(56) References Cited

U.S. PATENT DOCUMENTS

| | | | | |
|---|---|---|---|---|
| 5,435,645 | A * | 7/1995 | Faccioli et al. | 366/130 |
| 5,934,803 | A | 8/1999 | Hutter | |
| 5,951,160 | A * | 9/1999 | Ronk | 366/130 |
| 6,017,349 | A | 1/2000 | Heller et al. | |
| 6,024,480 | A | 2/2000 | Seaton et al. | |
| 6,406,175 | B1 * | 6/2002 | Marino | 366/130 |
| 6,984,063 | B2 * | 1/2006 | Barker et al. | 366/139 |
| 2003/0021180 | A1 | 1/2003 | Wahlig et al. | |
| 2004/0066706 | A1 | 4/2004 | Barker et al. | |

FOREIGN PATENT DOCUMENTS

| | | |
|---|---|---|
| WO | WO 97/18031 | 5/1997 |
| WO | WO 99/37256 | 7/1999 |
| WO | 01/83094 A1 | 11/2001 |

* cited by examiner

*Primary Examiner* — Nathan Bowers
(74) *Attorney, Agent, or Firm* — Tutunjian & Bitetto, P.C.

(57) ABSTRACT

The present invention has its application in the field of devices and methods for the product physical and chemical mixing and refers particularly to a cartridge for sterile mixing of a two-phase compound. The cartridge includes a first tubular body defining a first collection chamber for a solid phase, a second tubular body defining a second collection chamber for a liquid phase, means for transferring the liquid phase from the second to the first chamber, means for mixing the phases. The means for mixing comprise means for agitating acting on the mixture inside the first chamber with the first tubular body in substantially stationary conditions, so as to favor the dispersion of the solid phase inside the liquid phase thus obtaining a compound with uniform physical and mechanical properties.

20 Claims, 3 Drawing Sheets

CARTRIDGE FOR STERILE MIXING OF A TWO-PHASE COMPOUND, PARTICULARLY FOR TWO-COMPONENT ACRYLIC RESINS

TECHNICAL FIELD

The present invention finds its application in the field of devices and methods for physical and chemical mixing of products and refers particularly to a cartridge for sterile mixing of a two-phase compound.

BACKGROUND ART

As is known, in arthroplasty operations, performed to treat bone or vertebra pathologies, and in operations for the implanting and stabilisation of bone prostheses, acrylic resins or bone cements are usually used to be introduced in the specific area to be treated.

The materials normally used in this field of surgery consist of a liquid phase, generally monomeric, used as a solvent for the polymerisation of a resin in powder form, to which may be added antibiotic drugs, promoters of growth or the like.

For these operations, the resin must be prepared directly in the operating theatre. Consequently, the two phases are initially enclosed in two separate containers and then mixed immediately before introduction into the bone or vertebra area to be treated.

Considering the critical nature of these types of operations, it is most important that the utmost sterility of the resin and the resin dispensing devices be guaranteed at all stages.

Normally, the liquid is kept inside a plastic bag or a glass phial and then poured into a container in which powder has been previously collected. Subsequently, an operator mixes the two components using a spatula driven manually or mechanically. Finally, the compound thus obtained is introduced into a dispensing syringe and then injected under pressure through a special needle, into the bone cavity of the implant.

Such known solutions have the evident and recognised disadvantage of placing the compound into contact with the outside environment, thereby negatively affecting the sterility of the operation and making the resin a hazardous vehicle of infections for the person undergoing therapy. At the same time, the operator is placed in contact with a highly-reactive and toxic monomeric liquid, the vapours of which can freely spread in the work environment, with high risk of inhalation by the operator.

The preparation and the final composition of the mixture is, furthermore, strongly dependent on the particular skill of the operator, and so the risk exists of obtaining cements that are not perfectly homogeneous or, again, with incorrect proportions between the two phases.

In an attempt to overcome the above disadvantages, various solutions have been placed at disposal whereby one or more of such disadvantages are overcome.

From U.S. Pat. No. 5,435,645, in the name of the same applicant, a device is known for mixing bone cements in which the preparation of the cement is carried out in conditions of sterility and safety for the operator. The liquid is in fact initially placed inside a first chamber and then forced to pass into a second chamber containing the powder. This way a cement is also obtained that has the right proportions between monomer and powder.

A drawback of such solution is however represented by the fact that the mixing of the two phases is done by manually shaking the whole device. This operation thus strongly depends on the skill of the single mixing operator. Being naturally impossible to precisely establish the shaking time and energy required to obtain a uniform component mix, it follows that the compound is not always shaken enough and this does not therefore show the most suitable physical characteristics. The operation is also not at all easy.

From WO-A-0183094 a device is known for mixing a bone cement in which the mixture of liquid and solid is favoured by the sliding of an agitator disc inside the mixing chamber. This way, a uniform compound is produced of correct phase proportions. Nevertheless, an evident disadvantage of such solution is represented by the fact that the liquid phase is initially taken from a container by means of a common syringe and then introduced into the mixing chamber. These phases therefore do not guarantee absolute sterility of the cement besides being inconvenient and dangerous for the operator.

DISCLOSURE OF THE INVENTION

The purpose of this invention is to overcome the above drawbacks and make a cartridge for mixing a two-phase compound with clearly efficient features and which is relatively inexpensive.

A particular purpose is to make a cartridge for mixing a two-phase compound that permits obtaining a compound with homogeneous chemical, physical and mechanical characteristics in conditions of absolute sterility.

A further purpose is to make a cartridge for mixing a two-phase compound which is easy and safe to use for each operator.

Such purposes, as well as others which will appear clearer later on, are achieved by a cartridge for the sterile mixing of a two-phase compound, as in claim 1, comprising a first tubular body defining a first collection chamber substantially longitudinal for a solid phase, a second tubular body defining a second collection chamber for a liquid phase, means for mixing the liquid phase with the solid phase, characterized by the fact that the mixing means comprise agitator means acting on the mixture inside the first chamber with the first tubular body in substantially stationary conditions.

Thanks to this particular configuration, the cartridge according to the invention favours the dispersion of the solid phase inside the liquid phase thus making it possible to obtain a compound with uniform chemical, physical and mechanical properties in conditions of absolute sterility. The presence of agitator means in fact permits the uniform diffusion of the solid phase in the liquid phase, thereby ensuring perfect component mixing homogeneousness.

Advantageously, the agitator means can include a mobile agitator element which will be housed inside the first chamber and can be at least partially hollow and will be preferably transversal and shaped like a grid.

Preferably, the mobile agitator element can be coupled to means of movement that can be operated by an operator.

Advantageously, the means of movement can include a gripping element outside the first and second chamber and rigidly coupled to the mobile agitator element by means of suitable linking means. The latter may, in turn, comprise at least one, preferably a pair of rods with a first end connected to the gripping element and a second end connected to the mobile agitator element.

Preferably, the first tubular body can feature a top cover with at least a first guide opening for the connection rod which can be shaped like a slot.

Thanks to this characteristic, it will be possible to make a cartridge for mixing a two-phase compound that is easy and safe to use by each operator. The agitator element will in fact be of simple and light manufacture and may, furthermore, be easily operated by means of the alternate movement of the grip element and with minimum expenditure of energy. Moreover, the characteristics of the compound will always be reproducible to the same extent.

As required, the means for transferring the liquid phase into the first chamber can comprise at least one through cavity made on the end portion of the second tubular body.

Preferably, the transfer means can comprise pressure means operating between the first and the second chamber and, according to a particular form of embodiment, the pressure means can feature an open portion of the side wall of the second tubular body enclosed by an elastically yielding membrane deformable towards the inside.

Thanks to this latter characteristic, during mixing, the compound components are prevented from coming into contact with the outside and sterility is maintained.

BRIEF DESCRIPTION OF THE DRAWINGS

Further characteristics and advantages of the invention will appear even more evident from the detailed description of a preferred, but not exclusive, form of embodiment of a mixing cartridge according to this invention, illustrated by way of non limiting example in the attached drawings, wherein.

WAYS OF CARRYING OUT THE INVENTION

Figure 1:
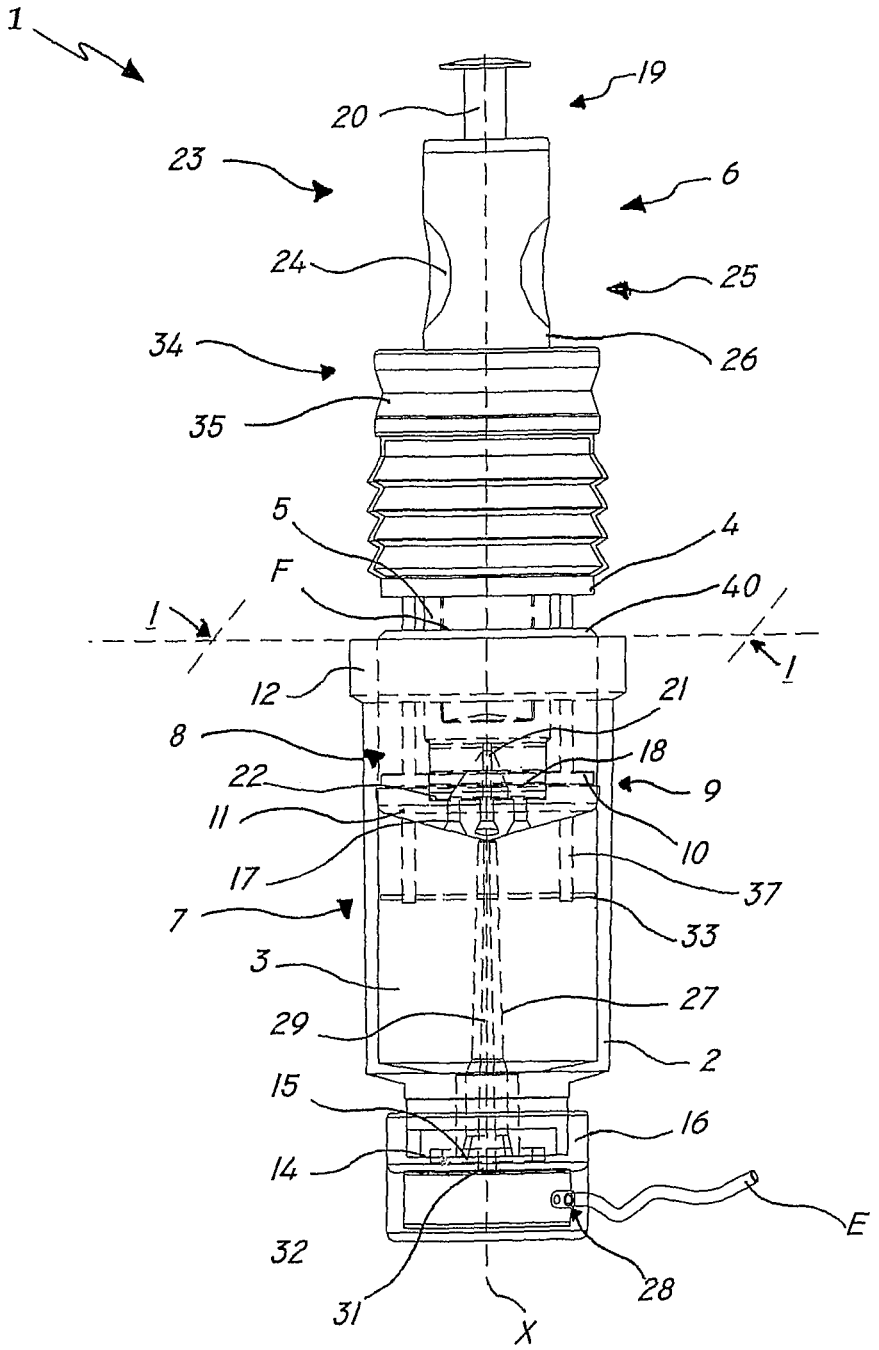
FIG. 1 is a front view of a cartridge according to the invention in a first preferred embodiment.

With reference to the above mentioned figures, the cartridge according to the invention, generally designated by reference numeral 1, may be used to mix, in sterile conditions, the components of a bone cement acrylic resin for arthroplasty operations or bone or joint prostheses implants. The compound will consist of a liquid phase, generally monomeric, and of a solid phase in powder state, if necessary with the addition of antibiotic agents or growth promoters, which polymerises once dissolved in the liquid phase. According to another possible use, the compound may also be a pharmaceutical product chosen from among the antibiotics, vitamins or the like. The two phases will, in any case, be initially kept separate.

Figure 2:
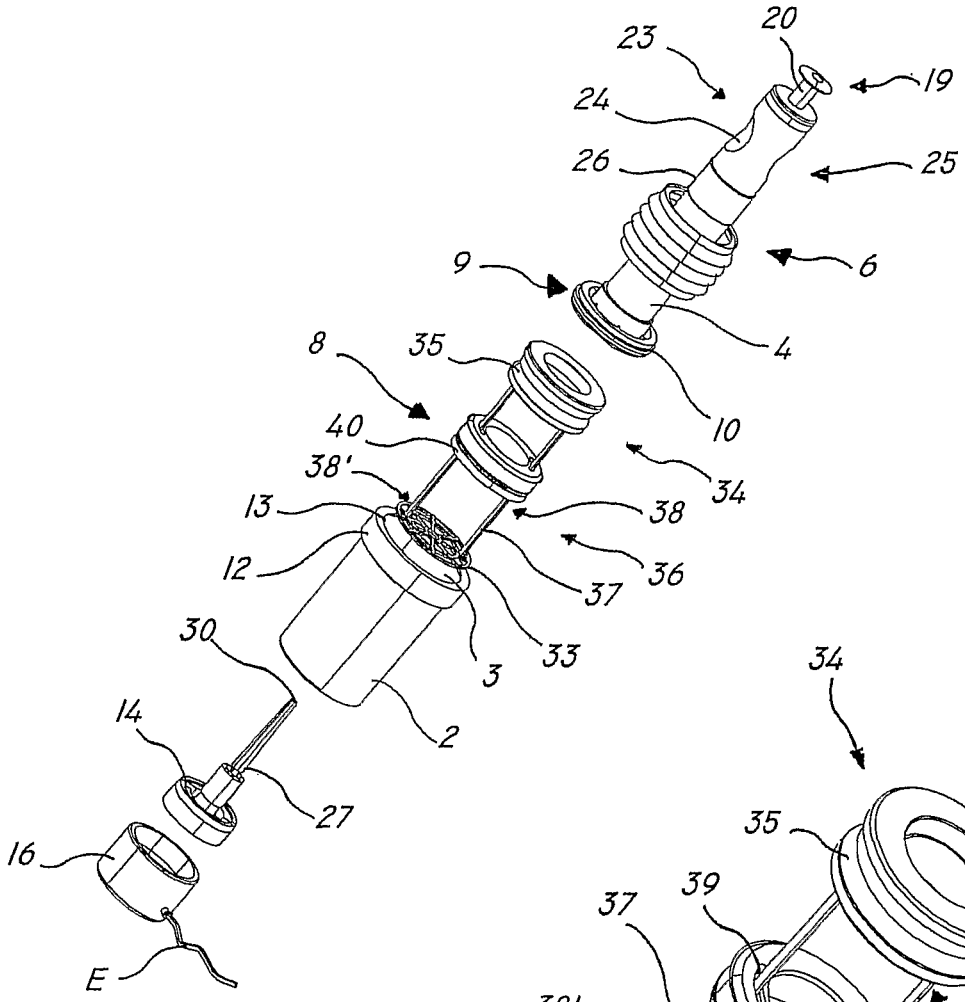
FIG. 2 is an exploded view of cartridge of FIG. 1.

As shown particularly in FIGS. 1 and 2, the cartridge comprises a first tubular body 2, defining a first collection chamber 3 substantially longitudinal for the solid phase, and a second tubular body 4, defining a second collection chamber 5 for the liquid phase. The sterile transit of the liquid phase from the second chamber 5 into the first chamber 3 is by means of suitable transfer means 6 which maintain sterility.

The different parts of the cartridge 1 can be made of plastic, rigid or semi-rigid, with suitable stress resistance characteristics.

Preferably the material will be transparent and the cartridge 1 will be of the disposable type.

According to the invention, means 7 are comprised for mixing the liquid phase with the solid phase which comprise further means for agitating 8 to favour the dispersion of the solid phase inside the liquid phase while keeping the first tubular body 2 substantially stationary.

As illustrated, the second tubular body 4 features the lower end portion 9 housed sliding and coaxially inside the first tubular body 2.

Figure 4:
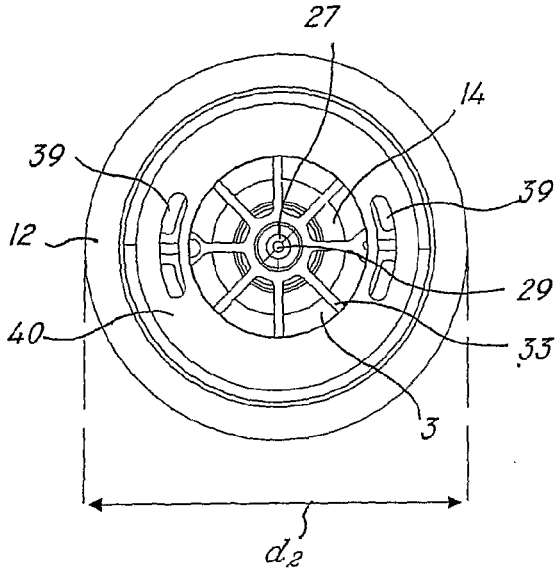
FIG. 4 is a view from above of a first detail of FIG. 1.

Suitably, at end portion 9 is a ring-shaped flange 10 with outer diameter d1 slightly less than the diameter d2 of the first chamber 3. The flange 10, together with the end portion 9, will act as a piston 11 in the last resin dispensing phase. As specifically shown in FIG. 4, the first tubular body 2 will feature an upper portion 12 with an entry door 13 made in central position to allow transit of the second tubular body 4. The first body 2 will on the other hand be closed in opposite position by a rear wall 14 featuring a through hole 15 for dispensing the mixed resin towards suitable external implantation means E. During the mixing stage, the through hole 15 will be closed by a closing element 16, such as, for example, a cap that screws onto it, which will be removed when the compound is dispensed ready for use.

Figure 5:
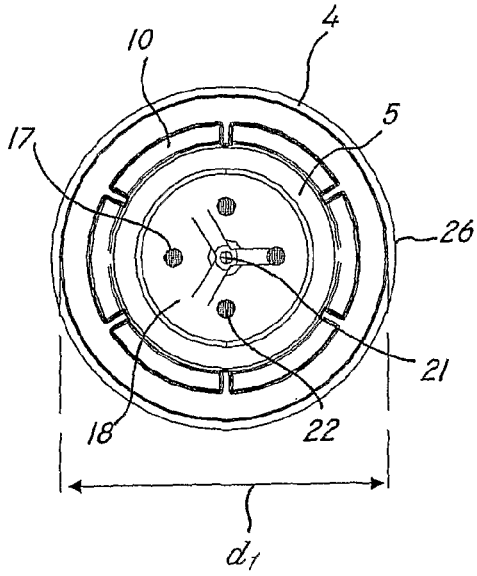
FIG. 5 is a section view according to the tracing plan I-I of a further detail of the cartridge in FIG. 1.

Advantageously, the means for transferring 6 for putting the collection chambers 3, 5 in fluid communication will comprise a series of through cavities 17 made on the lower wall 18 of the second body 4, visible in FIG. 5.

The liquid phase can be introduced into the second chamber 5 inside a suitable container F, such as for instance a breakable glass phial, through specific breaking means 19 positioned inside the second chamber 5. The means 19 will preferably comprise an upper cylindrical element 20 sliding inside the second chamber 5, and a pointed element 21 longitudinally opposite. The upper element 20 will be operated from outside so as to push the phial F against the pointed element 21 causing this to break and, therefore, the liquid phase to pour into the first chamber 3 passing through the through cavities 17. Downstream of the latter, a first filter element 22 will also be located to prevent the transit of fragments of glass produced by the breakage of phial F or, again, the transit of the solid phase in the opposite direction.

Preferably, to favour the transit of the liquid phase inside the first chamber 3, the means for transferring 6 can comprise means for adjusting pressure 23 able to determine, inside the first chamber 3, a reduction in pressure and consequently a lower pressure compared to that existing inside the second chamber 5. This way, the liquid will be recalled inside the first chamber 3 by the vacuum generated inside this.

In a first preferred but not exclusive form of embodiment of the invention, shown in FIGS. 1 and 2, the means for adjusting pressure 23 will comprise an elastically yielding membrane 24 which closes an open portion 25 of the side wall 26 of the second tubular body 4. By adjusting the pressure on membrane 24, the operator can change the volume inside the second collection chamber 5 and when this is released, the above vacuum will be produced.

Figure 6:
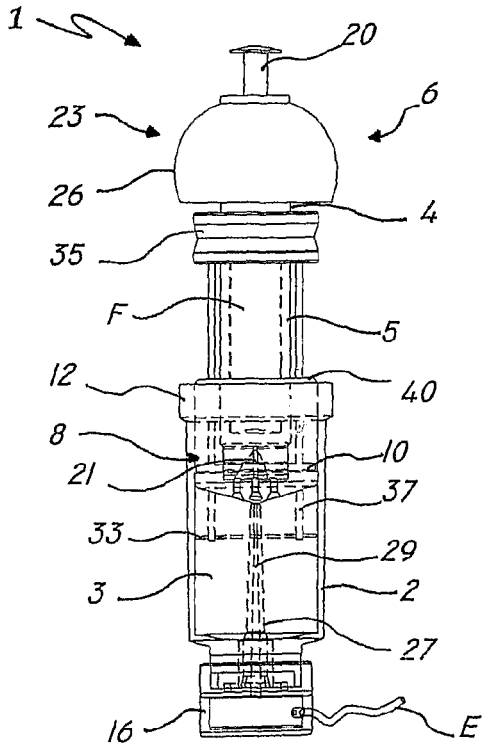
FIG. 6 is a front view of a cartridge according to the invention in a second preferred form of embodiment.

In a second form of embodiment, shown in FIG. 6, the means for adjusting pressure 23 can consist of the same piston 11, which, operated by the alternative sliding in axial direction of the second tubular body 4, will determine the vacuum inside the first collection chamber 3 and, consequently, the transit of the liquid inside this. In each configuration, a stop element 27 will also be fitted to restrict the movement of the piston 11. The element 27 will be substantially longitudinal, and will protrude inside the first chamber 3 and will be associated with the closing element 16. This way, any contact between piston 11 and the powder will be avoided during generation of the vacuum in the first chamber 3.

Figure 3:
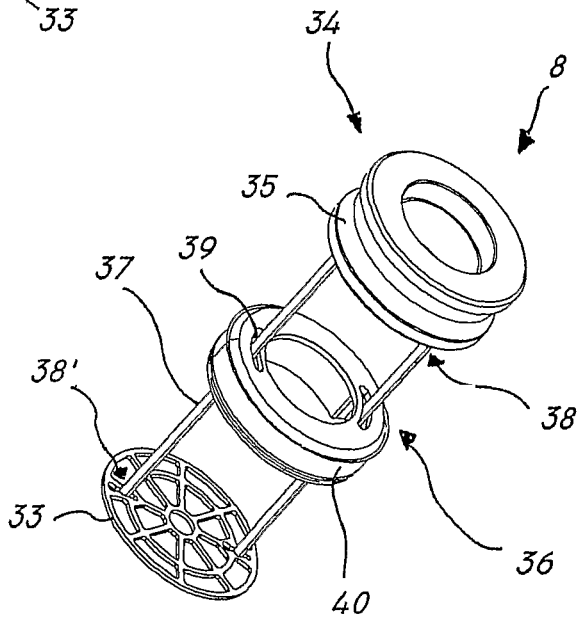
FIG. 3 is an enlarged view of a detail of FIG. 2.

In order to achieve a strong vacuum inside the first chamber 3, the means for transferring 6 will comprise suitable means for connecting 28 of the first collection chamber 3 to the external vacuum means E. The means for connecting 28 will comprise a pipe 29 made inside the stop element 27 and having a longitudinal direction X, according to the development of element 27 itself. The pipe 29 will feature a free entrance 30 inside the first chamber 3 and an exit 31 inside the closing element 16 and downstream of which a second filter element 32 will be positioned. The latter can be a microbiological filter, for example of the active charcoal type, designed to preserve the sterility of the compound housed in the first collection chamber 3, particularly during the vacuum creation phase. After the transit of the liquid phase inside the first chamber 3, the mixing will occur of the two phases present at the same time inside the first chamber 3, manually operating the means for agitating 8, particularly shown in FIG. 3.

Advantageously, the means for agitating 8 will comprise a mobile agitator element 33 inside the first chamber 3 and at least partially hollow. Preferably, the element 33 will be configured like a flat grid with development substantially transversal with respect to the longitudinal dimension of the cartridge 1, its being possible furthermore to make it of the same material as cartridge 1 or of a similar material.

The movement of the agitator element 33 will be suitably simplified by coupling this with suitable means of movement 34 that can be operated from outside by an operator.

The means 34 will comprise a gripping element 35 outside the collection chamber of phases 3, 5 configured like a round crown coaxial to the second tubular body 4, rigidly coupled to the agitator element 33 by means of specific means for linking 36. The latter will be substantially a pair of rods 37 arranged symmetrically to the development axis X.

The rods 37 will have a first end 38 connected to the gripping element 35 and a second end 38' connected to the agitator element 33. Furthermore, the rods 37 will be conducted through respective guide openings 39 made in a ring nut 40 that can be fitted at the upper portion 12 of the first tubular body 2, so as to slide sealed. The guide openings 39 will be configured as slots to permit partial rotation of the agitator means 8 around the longitudinal direction X, so as to ensure more efficient mixing of the phases. After mixing, the resin will be ready to be dispensed towards the external implantation means. For this purpose, the closing element 16 will be removed from the hole 15 on the rear wall 14, the implantation means E will be connected and the resin will be dispensed by means of adequate pressure applied by means of piston 11 operated by means of the thrust applied by the operator on the second tubular body 4.

From the above description, it is evident that the cartridge according to the invention achieves the intended purposes, and particularly to allow the phase mixing so as to obtain a two-phase compound with homogenuous chemical, physical and mechanical characteristics and in conditions of absolute sterility.

Furthermore, thanks to the special configuration of the mixing means, it is possible to achieve a cartridge being safe and easy to use for any operator.

The cartridge according to the invention is susceptible of numerous modifications and variations, all of which falling within the scope of the inventive concept as contained in the enclosed claims. All the details can be replaced with others that are technically equivalent and the materials used may be any according to requirements without because of this moving outside the protection scope of the invention.

The cartridge has also been described with special reference to the attached figures, the reference numbers used in the description and claims are used to upgrade the intelligence of the invention and do not represent any limitation to the claimed protection scope.

The invention claimed is:

1. A cartridge for the sterile mixing of a two phase compound consisting of a liquid phase and a solid phase which can be mixed immediately before dispensing, comprising:

a first tubular body defining a first collection chamber for a solid phase, said first tubular body extending substantially longitudinal along a longitudinal axis (X);

a second tubular body defining a second collection chamber for a liquid phase, said second tubular body being arranged for sliding coaxially to and inside said first tubular body;

means for transferring said liquid phase from said second to said first chamber; and means for mixing said liquid phase with said solid phase, wherein said means for mixing comprises a means for agitating acting on the mixture of said phases inside said first chamber with said first tubular body in substantially stationary conditions, so as to favor the dispersion of the solid phase inside the liquid phase thus obtaining a compound with uniform physical and mechanical properties in conditions of absolute sterility, wherein said means for agitating comprises an agitator body which is configured for moving coaxially to and between said first collection chamber and said second collection chamber, said agitator body being substantially hollow for housing and receiving axially said second collection chamber, wherein said agitator body comprises a mobile agitator element housed inside said first collection chamber, wherein said mobile agitator element is coupled to means of movement, comprising a gripping element arranged outside said first and said second chamber, which is suitable to be operated by an operator for moving said mobile agitator element in said first collection chamber, and wherein said agitator body of said means for agitating further comprises a suitable means for linking configured to provide rigid coupling of said gripping element to said mobile agitator element spaced from said longitudinal axis (X).

2. The cartridge according to claim 1, wherein said mobile agitator element is at least partially hollow and with a development substantially transversal with respect to the longitudinal dimension of said first tubular body.

3. The cartridge according to claim 1, wherein said mobile agitator element is substantially shaped like a grid.

4. The cartridge according to claim 3, wherein said means for linking comprises at least one, preferably a pair of rods spaced from the axis (X) and having a first end connected to said gripping element and a second end connected to said mobile agitator element.

5. The cartridge according to claim 4, wherein said first tubular body features an upper portion with an entry door for said second tubular body and a ring nut with at least one guide opening for said at least one rod, said first body also featuring a rear wall with a through hole for dispensing the mixed compound and a removable closing element for shutting said through hole.

6. The cartridge according to claim 5, wherein said at least one guide opening is configured as a slot to permit at least a partial rotation of said agitator means around the longitudinal development direction (X) of said first tubular body.

7. The cartridge according to claim 6, wherein said second tubular body features an end portion housed sliding and coaxially inside said first tubular body passing through said entry door of said upper portion.

8. The cartridge according to claim, 7, wherein said end portion of said second body features a ring-shaped flange with outer diameter (d1) corresponding to diameter (d2) of said first chamber to define a piston for dispensing the mixed compound.

9. The cartridge according to claim 8, wherein said means for transferring of said liquid phase from said second to said first chamber comprises at least one through cavity made by said end portion of said second tubular body, said at least one through cavity being fitted with at least one first filter element.

10. The cartridge according to claim 1, wherein said means for transferring comprises means for adjusting pressure acting between said first and said second chamber.

11. The cartridge according to claim 10, wherein said means for adjusting pressure comprises an open portion of the side wall of said second tubular body, closed by an elastically yielding membrane deformable towards the inside.

12. The cartridge according to claim 1, comprising a stop element for said agitator element substantially longitudinal and associated with said closing element and protruding inside said first chamber.

13. The cartridge according to claim 1, wherein said means for transferring comprises means for connecting said first collection chamber to the external vacuum means so as to increase the vacuum inside said first chamber.

14. The cartridge according to claim 13, wherein said means for connecting comprises a substantially longitudinal pipe made inside said stop element, said pipe having an entrance inside said first chamber and an exit inside said closing element, said closing element featuring a second filter element downstream said exit.

15. The cartridge of claim 1, wherein said rigid coupling of said gripping element to said mobile agitator element spaced from said longitudinal axis (X) comprises a pair of rods arranged symmetrically around the axis (X).

16. The cartridge of claim 4, further comprising a ring nut for fitting at an upper portion of the first tubular body, said ring nut including slots disposed along a circumference of the ring nut, wherein the rods are conducted through the slots to permit partial rotation of the means for agitating around the axis (X).

17. The cartridge of claim 1, wherein said second tubular body includes an end portion having a piston configured for sliding inside the first tubular body, and further comprising a substantially longitudinal stop element protruding inside the first chamber to restrict movement of the piston.

18. The cartridge of claim 1, wherein said second tubular body includes an end portion having a piston configured for sliding between a linking means, and further comprising a substantially longitudinal stop element protruding inside the first chamber to restrict movement of the piston.

19. A cartridge for the sterile mixing of a two phase compound comprising:

a first tubular body defining a first collection chamber for a solid phase, said first tubular body extending substantially longitudinal along a longitudinal axis (X);

a second tubular body defining a second collection chamber for a liquid phase, said second tubular body being arranged for sliding coaxially to and inside said first tubular body;

means for transferring of said liquid phase from said second to said first chamber; and means for mixing said liquid phase with said solid phase, wherein said means for mixing includes an agitator body configured for moving coaxially to and between said first collection chamber and said second collection chamber, said agitator body being substantially hollow for housing and receiving axially within said agitator body said second collection chamber, wherein said agitator body includes a gripping element rigidly coupled to a mobile agitator element by a pair of rods spaced from the axis (X), said pair of rods having a first end connected to the gripping element and a second end connected to the mobile agitator element.

20. The cartridge of claim 19, further comprising a ring nut for fitting at an upper portion of the first tubular body, said ring nut including at least two slots disposed along a circumference of the ring nut, wherein the rods are conducted through the slots, said slots being configured to permit partial rotation of the agitator body around the axis (X).

* * * * *